US006299701B1

(12) United States Patent
Aubay et al.

(10) Patent No.: US 6,299,701 B1
(45) Date of Patent: Oct. 9, 2001

(54) DISHWASHER DETERGENT COMPOSITION CONTAINING AN ANTICORROSIVE AGENT

(75) Inventors: Eric Aubay, Courbevoie (FR); Agnès Froute, Altrincham (GB); Aude Guirauden, Paris; Daniel Joubert, Vineuil Saint Firmin, both of (FR)

(73) Assignee: Rhone-Poulenc Chimie, Courbevoie Cedex (FR)

( * ) Notice: Subject to any disclaimer, the term of this patent is extended or adjusted under 35 U.S.C. 154(b) by 0 days.

(21) Appl. No.: 09/230,042

(22) PCT Filed: Jul. 15, 1997

(86) PCT No.: PCT/FR97/01311

§ 371 Date: Mar. 17, 1999

§ 102(e) Date: Mar. 17, 1999

(87) PCT Pub. No.: WO98/02515

PCT Pub. Date: Jan. 22, 1998

(30) Foreign Application Priority Data

Jul. 16, 1996 (FR) ..... 96 09064
Nov. 20, 1996 (FR) ..... 96 14137

(51) Int. Cl.[7] ..... C11D 7/14; C11D 3/08

(52) U.S. Cl. ..... 134/42; 134/25.2; 510/179; 510/221; 510/228; 510/233; 510/238; 510/435; 510/466; 510/509; 510/511

(58) Field of Search ..... 510/179, 221, 510/228, 233, 238, 435, 466, 509, 511; 134/25.2, 42

(56) References Cited

U.S. PATENT DOCUMENTS 3,933,670 * 1/1976 Brill et al. ..... 252/99
5,703,027 * 12/1997 Caravajal ..... 510/232

FOREIGN PATENT DOCUMENTS 0 416 366 3/1991 (EP) .
0 561 656 9/1993 (EP) .
WO 96/17047 A1 * 6/1996 (EP) .
96 17047 6/1996 (WO) .

OTHER PUBLICATIONS

Database WPI, Section Ch, Week 8011, Derwent Publications Ltd., London, GB, XP002028414 & JP 55 016 014 A (Asahi Denka Kogyo), 4 see abstract Feb. 4, 1980.

* cited by examiner

*Primary Examiner*—Mark Kopec
*Assistant Examiner*—Brian P. Mruk
(74) *Attorney, Agent, or Firm*—Burns, Doane, Swecker & Mathis, L.L.P.

(57) ABSTRACT

A detergent composition containing alkali-metal silicate with an average molar ratio of $SiO_2/M_2O$ of 1–4.2, preferably 2.5–4.2, wherein M is an alkali metal, the composition being non-corrosive to glass, crystal, porcelain and decorative prints thereon upon repeated washing. The composition being such that when disposed in a washing medium at a normal working concentration, a protonated silicic monomer $Si(OH)_4$ is produced in a concentration of at least $2.5\times10^{-3}$ mol/liter of the washing medium.

14 Claims, 4 Drawing Sheets

DISHWASHER DETERGENT COMPOSITION CONTAINING AN ANTICORROSIVE AGENT

The present invention relates to a dishwasher detergent composition based on an alkali metal silicate, which is not corrosive towards glass, crystal, porcelain or patterns; it is also directed towards the use of the said non-corrosive dishwasher detergent composition, as well as to the dishwasher-washing process using it.

One of the major problems encountered in the use of dishwashers is the phenomenon of irreversible corrosion of the items being washed (glass, crystal, porcelain) which is observed after repeated washing.

In the case of glass, this irreversible corrosion is reflected first in a phenomenon of iridescence and then in a frosted white appearance of the glass; this is accompanied by a loss of mass.

The phenomenon of glass corrosion by aqueous solutions has been the subject of studies, in particular in the field of stability of inertization glasses for nuclear waste ("Corrosion of Glass, Ceramics and Ceramic Superconductor, Principles, Testing, Characterization and Application" edited by D. E. Clark and B. K. Zoitos, Noyes Publications, 1992). In applications of this type, the conditions under which the glass is attacked do not correspond to those encountered during washing in a dishwasher, whether as regards the pH of the solutions, the temperature or the dynamic nature of the corrosion in a dishwasher.

The use of silicates as detergent adjuvants in dishwasher detergent compositions is well known; certain authors mention the ability of these adjuvants to limit the corrosion of glass, porcelain and glazing on articles (E. J. Schuck, Proc. Mid-Year Meet, Chem. Spec. Manuf. assoc. (1972), Vol. 58, pp. 82–85; M. Hellsten, Tenside detergents, 9, Heft 4, pp. 178–182 (1972); U.S. Pat. No. 3,494,868; WO 96/17047).

Two types of formulations should be distinguished in this context (W. Buchmeir, Glatech. Ber. Glass Sci. Tecnol. (1996) No. 6, pp. 159–167),

- very alkaline formulations based on metasilicate, developing a pH of about 12 to 13, giving little visible corrosion of plain glass, but leading to damage to patterned articles and glazings, and
- moderately alkaline formulations, developing a pH of about 9 to 11.5, giving effective protection of patterned articles and glazings, but resulting in strong visible corrosion of clear glass.

The use of these two types of formulations leads to a loss of mass and to damage to the articles.

An in-depth study of the mechanisms of corrosion of glass and crockery has shown that this corrosion is due in particular to hydrolysis of the glass lattice accompanied by a phenomenon of leaching of the ions from the glass into the bath.

The Applicant has found a solution which simultaneously solves both problems, i.e. of loss of mass and of damage to articles.

The Applicant has put forward the hypothesis that the use of a washing bath comprising in its chemical composition a "silicate portion" similar to that of the silicic lattice of glass would eliminate the phenomenon of hydrolysis and thus limit, or even remove altogether, the corrosion of the glass at the hydrolysis stage by cleavage of Si—O—Si bonds in the glass lattice.

The Applicant has found that the phenomenon of glass corrosion by repeated washing in a dishwasher is greatly reduced, or even stopped, by the presence in the washing bath of a sufficient amount of protonated silicic monomer $Si(OH)_4$; it has observed that this performance is also obtained on porcelain, patterns on glass or on porcelain, and crystal.

A first subject of the invention consists of the use, to eliminate or limit the corrosion of glass, crystal or porcelain articles and patterns on glass or porcelain by repeated washing in a dishwasher, of a detergent composition which generates a washing medium with a concentration of protonated silicic monomer $Si(OH)_4$ of at least $2.5\times10^{-3}$ mol/liter of washing medium, preferably of at least $3\times10^{-3}$ mol/liter of washing medium, most particularly from about $3\times10^{-3}$ to about $9\times10^{-3}$ mol/liter of washing medium.

A second subject of the invention consists of a process for the non-corrosive washing in a dishwasher of glass, crystal or porcelain articles which may be patterned, by using a detergent composition which generates a washing medium with a concentration of protonated silicic monomer $Si(OH)_4$ of at least $2.5\times10^{-3}$ mol/liter of washing medium, preferably of at least $3\times10^{-3}$ mol/liter of washing medium, most particularly from about $3\times10^{-3}$ to about $9\times10^{-3}$ mol/liter of washing medium.

The said washing medium preferably has a pH of greater than 9.8, most particularly from about 9.9 to about 11.1.

One means for obtaining this sufficient concentration of protonated silicic monomer $Si(OH)_4$ in the washing bath consists in using, via a detergent composition, a sufficient amount of at least one alkali metal silicate in order to obtain a high content of $SiO_2$ capable of generating the said monomer and in promoting the formation of the said monomer by adjusting the pH of the bath by means of the choice of the nature of the said silicate and of the other ingredients of the composition as a function of the silicate chosen.

Any amorphous or crystalline soluble alkali metal silicate with an $SiO_2/M_2O$ ratio from about 1 to about 4.2 allows the desired aim to be achieved. Preferably, it is an amorphous soluble silicate.

One particularly favourable means consists in using, in the detergent composition, at least one soluble alkali metal silicate with an average $SiO_2/M_2O$ molar ratio from about 2.5 to about 4.2, which is preferably amorphous, making it possible to obtain in the washing bath a high content of $SiO_2$ and promoting a low bath pH which is compatible with an adequate content of protonated silicic monomer $Si(OH)_4$.

The term "soluble" silicate is intended to refer to any silicate in which at least 50% of the silica lattice is dissolved in the washing medium after 10 minutes under the washing conditions.

The term "average" $SiO_2/M_2O$ molar ratio is intended to refer to the ratio of the total number of moles of $SiO_2$ to the total number of moles of $M_2O$ arising from the alkali metal silicate(s) present in the detergent composition.

A third subject of the invention consists of a dishwasher detergent composition based on at least one alkali metal silicate with an average $SiO_2/M_2O$ molar ratio from about 1 to about 4.2, preferably from about 2.5 to about 4.2, M representing an alkali metal, this composition being non-corrosive towards glass, crystal, porcelain and patterns and generating, at the working concentration, a washing medium with a concentration of protonated silicic monomer $Si(OH)_4$ of at least $2.5\times10^{-3}$ mol/liter of washing medium, preferably of at least $3\times10^{-3}$ mol/liter of washing medium, most particularly from about $3\times10^{-3}$ to about $9\times10^{-3}$ mol/liter of washing medium.

In order to assist in the reading, the expression "alkali metal silicate" will be intended to refer hereinbelow both to an alkali metal silicate alone and to a mixture of several alkali metal silicates which can have different $SiO_2/M_2O$ molar ratios; the expression "average $SiO_2/M_2O$ molar ratio" thus corresponds either to a silicate alone, when only one silicate is present, or to a mixture of silicates, when several silicates with different molar ratios are present.

The concentration of protonated silicic monomer $Si(OH)_4$ in the washing medium depends on the total concentration of soluble $SiO_2$ in the washing medium and on the bath pH.

It is measured at 25° C. and expressed in mol/liter, according to equation (I) below:

$$[Si(OH)_4]=[\text{total } SiO_2 \text{ in the washing medium}]/\{1+10^{(pH-pK1)}+10^{(2pH-pK1-pK2)}\} \quad (I)$$

in which equation:

"pH" represents the pH of the washing medium at 25° C.

"pK1" represents the first pKa acidity constant of the silicic acid corresponding to the equilibrium $Si(OH)_4$ <===> $(SiO_4H_3)^-$; pK1 is equal to 9.8 at 25° C., according to the literature (R. H. Iler, "The Chemistry of Silica", A. Wiley—Interscience Publication 1979)

"pK2" represents the second pKa acidity constant of the silicic acid corresponding to the equilibrium $(SiO_4H_3)^-$ $(SiO_4H_2)^{2-}$; pK2 is equal to 12.2 at 25° C., according to the literature (R. H. Iler, "The Chemistry of Silica", A. Wiley—Interscience Publication 1979).

The expression "total concentration of soluble $SiO_2$ in the washing medium" is intended to refer to the amount of soluble $SiO_2$ in the washing medium arising from the soluble alkali metal silicate used.

Equation (I) can also be written as follows:

$$[Si(OH)_4]=[\text{total } SiO_2 \text{ of the washing medium}]/\{1+10^{(pH-9.8)}+10^{(2pH-22)}\}$$

Curve (a) corresponds to a concentration of protonated silicic monomer $Si(OH)_4$ of $2.5\times10^{-3}$ mol/liter of washing medium; curve (b) corresponds to a concentration of protonated silicic monomer $Si(OH)_4$ of $3\times10^{-3}$ mol/liter of washing medium.

Three zones are delimited by these two curves:

- to the right of curve (a), a zone corresponding to a concentration of protonated silicic monomer $Si(OH)_4$ of less than $2.5\times10^{-3}$ mol/liter of washing medium;
- between the two curves, a zone corresponding to a concentration of protonated silicic monomer $Si(OH)_4$ of between $2.5\times10^{-3}$ and $3.0\times10^{-3}$ mol/liter of washing medium;
- to the left of curve (b), a zone corresponding to a concentration of protonated silicic monomer $Si(OH)_4$ of greater than $3.0\times10^{-3}$ mol/liter of washing medium.

The zones to the left of curve (b) and between the two curves thus correspond to concentrations of protonated silicic monomer $Si(OH)_4$ within the range of the invention, the zone to the left of curve (b) corresponding to the preferred range of the invention.

In a particularly preferred manner, the concentration of protonated silicic monomer $Si(OH)_4$ in the washing medium is from about $3\times10^{-3}$ to about $9\times10^{-3}$ mol/liter of washing medium.

The said detergent composition can be in solid form (powder, tablets), in liquid form or in gel form.

The working concentration of a dishwasher detergent composition is generally from about 3 to about 12 g/liter of washing bath. More specifically, this is from about 4 to about 10 g/liter for a composition in powder form, from about 3 to about 6 g/liter for a composition in tablet form and from about 4 to about 12 g/liter for a liquid composition or a composition in gel form.

The pH of the washing medium is adjusted by the nature and amount of the alkali metal silicate and of the other pH-influencing additives present in the composition. The pH is preferably adjusted to a value of greater than 9.8, most particularly to a value from about 9.9 to about 11.1.

Figure 2:
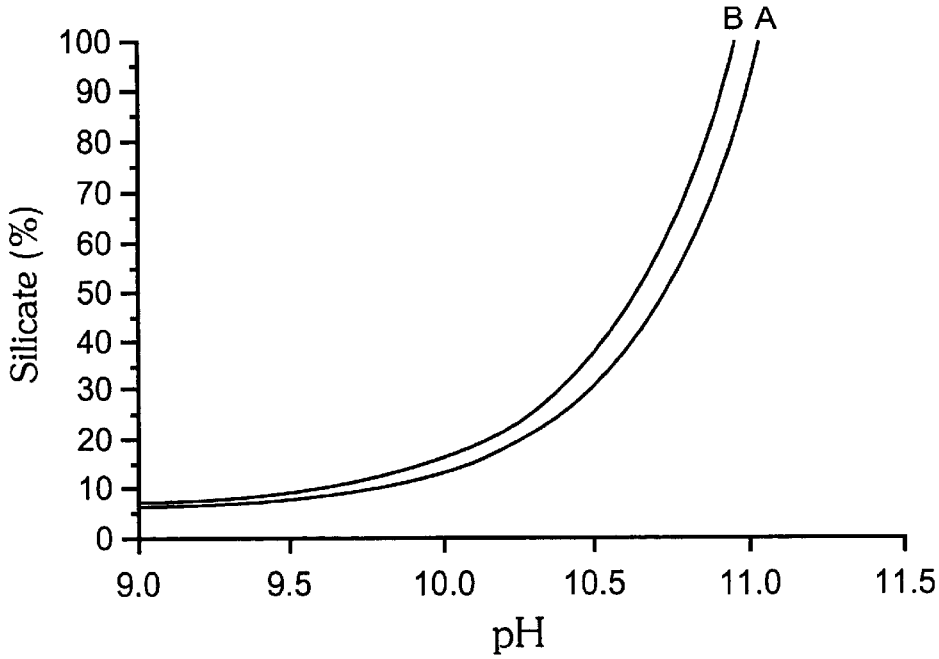
Figure 3:
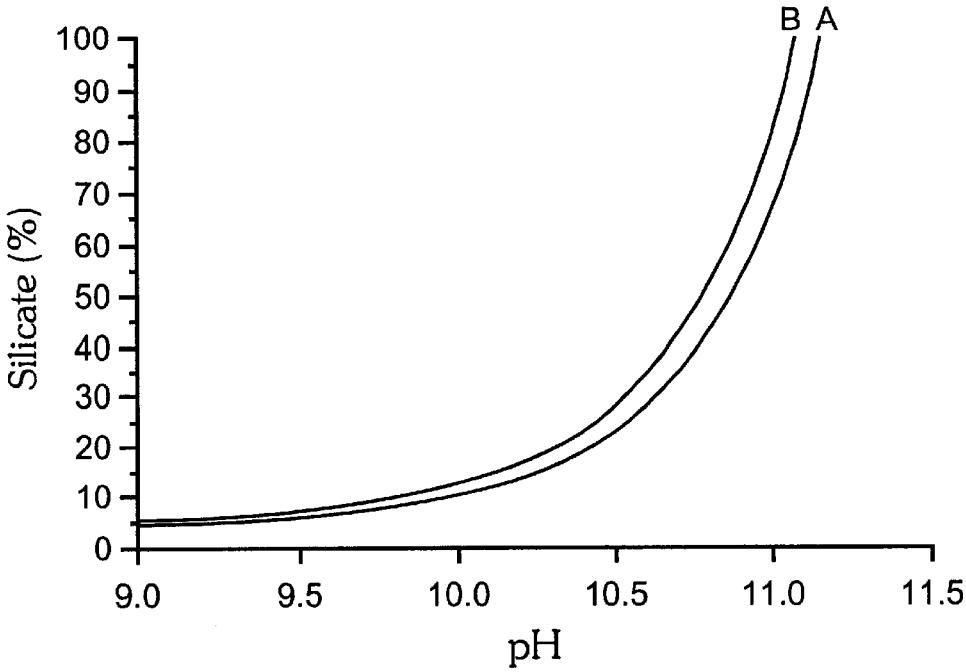
Figure 4:
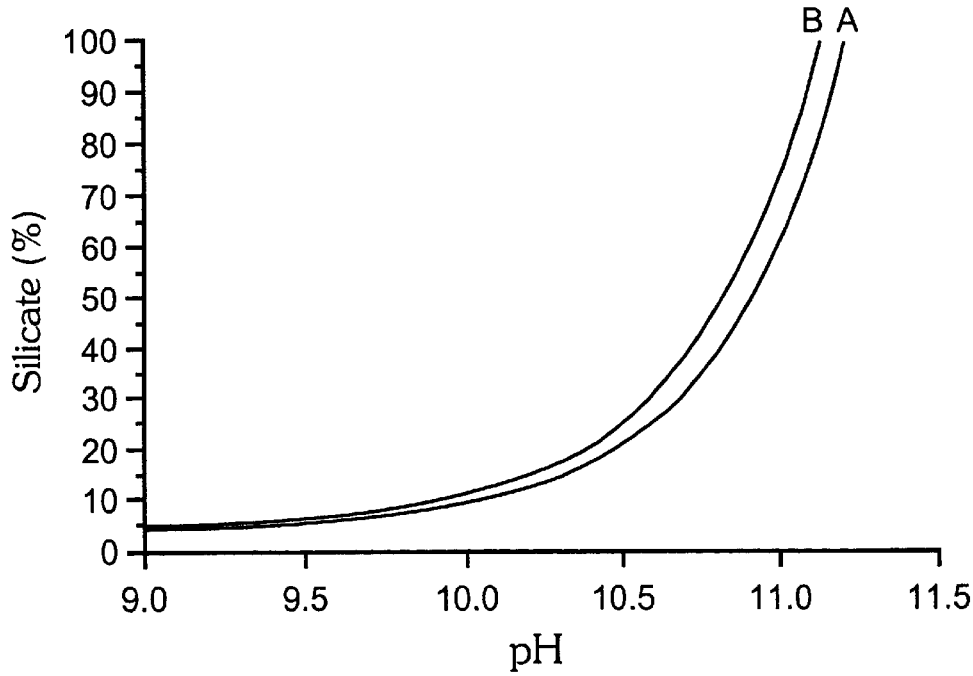

Curves (A) and (B) corresponding, respectively, to a concentration of protonated silicic monomer $Si(OH)_4$ of $2.5\times10^{-3}$ mol/liter and $3\times10^{-3}$ mol/liter of washing medium, given in FIGS. 2 to 4, make it possible, for a working concentration of 6 g/l of detergent composition in the washing medium, to define, as a function of the pH of the washing medium, the amounts of sodium silicate, with an average $SiO_2/Na_2O$ molar ratio=1 (FIG. 2), $SiO_2/Na_2O$ molar ratio=2.1 (FIG. 3) and $SiO_2/Na_2O$ molar ratio=3.3 (FIG. 4), respectively, which can be used in the detergent composition in order to carry out the invention.

Three zones are delimited by these two curves:

- to the right of curve (A), a zone corresponding to a concentration of protonated silicic monomer $Si(OH)_4$ of less than $2.5\times10^{-3}$ mol/liter of washing medium;
- between the two curves, a zone corresponding to a concentration of protonated silicic monomer $Si(OH)_4$ of between $2.5\times10^{-3}$ and $3.0\times10^{-3}$ mol/liter of washing medium;
- to the left of curve (B), a zone corresponding to a concentration of protonated silicic monomer $Si(OH)_4$ of greater than $3.0\times10^{-3}$ mol/liter of washing medium.

The zones to the left of curve (B) and between the two curves thus correspond to concentrations of protonated silicic monomer $Si(OH)_4$ within the range of the invention, the zone to the left of curve (B) corresponding to the preferred range of the invention.

Figure 5:
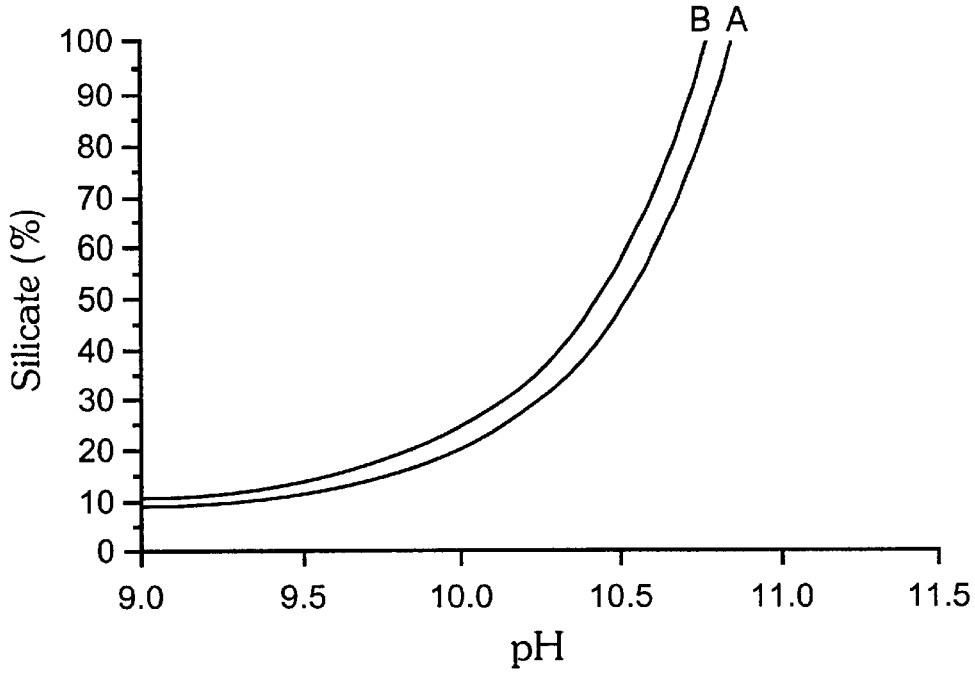
Figure 6:
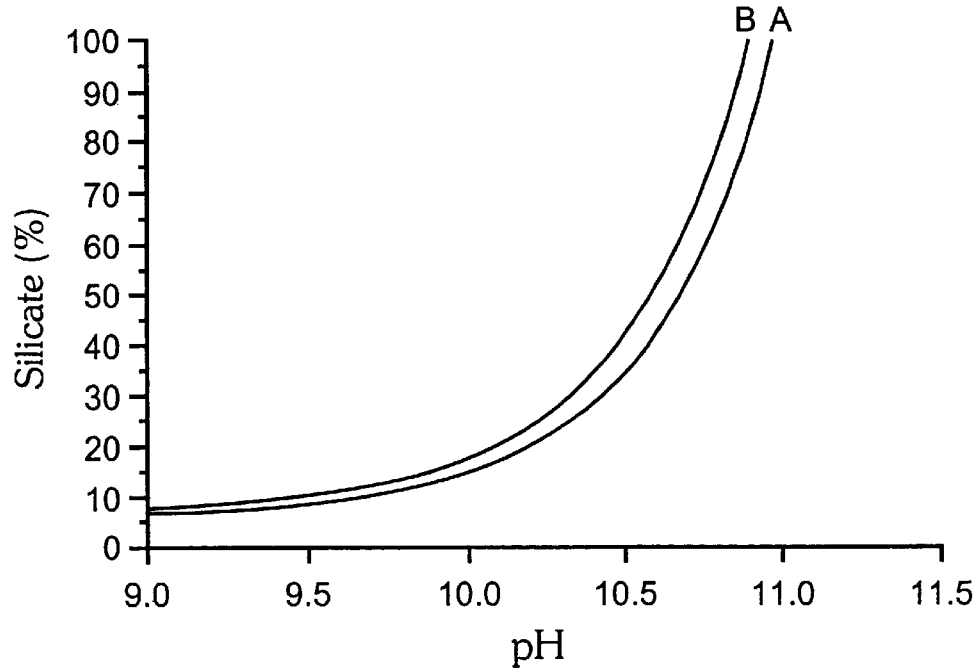
Figure 7:
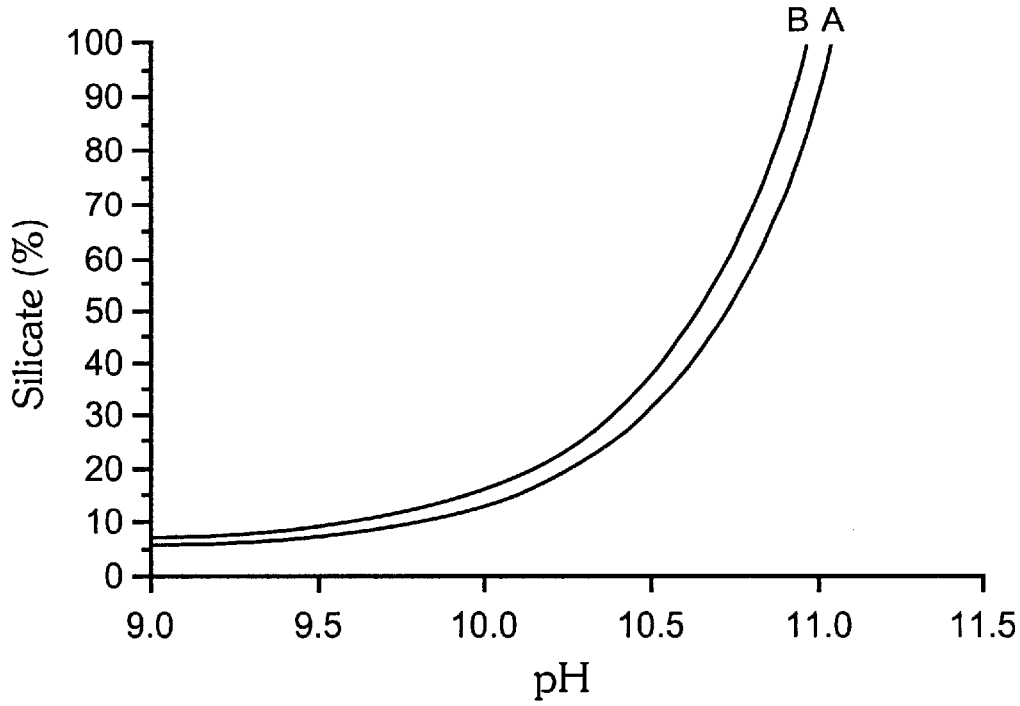

Curves (A) and (B) corresponding, respectively, to a concentration of protonated silicic monomer $Si(OH)_4$ of $2.5\times10^{-3}$ mol/liter and $3\times10^{-3}$ mol/liter of washing medium, given in FIGS. 5 to 7, correspond to a working concentration of 4 g/l of detergent composition in the washing medium with respective average molar ratios $SiO_2/Na_2O$=1 (FIG. 5), $SiO_2/Na_2O$=2.1 (FIG. 6) and $SiO_2/Na_2O$=3.3 (FIG. 7) of the sodium silicate.

Three zones are delimited by these two curves:

- to the right of curve (A), a zone corresponding to a concentration of protonated silicic monomer $Si(OH)_4$ of less than $2.5\times10^{-3}$ mol/liter of washing medium;
- between the two curves, a zone corresponding to a concentration of protonated silicic monomer $Si(OH)_4$ of between $2.5\times10^{-3}$ and $3.0\times10^{-3}$ mol/liter of washing medium;
- to the left of curve (B), a zone corresponding to a concentration of protonated silicic monomer $Si(OH)_4$ of greater than $3.0\times10^{-3}$ mol/liter of washing medium.

The zones to the left of curve (B) and between the two curves thus correspond to concentrations of protonated silicic monomer $Si(OH)_4$ within the range of the invention, the zone to the left of curve (B) corresponding to the preferred range of the invention.

The amount, by dry weight, of alkali metal silicate generally represents, depending on the form of detergent composition chosen, from about 5 to about 55%, preferably from about 10 to about 40%, of the dry weight of the said composition.

More specifically, for a solid detergent composition, powder or tablet, the amount of silicate represents from about 5 to about 55%, preferably from about 10 to about 40%, of the dry weight of the said composition, and for a liquid composition or a composition in gel form the amount of silicate represents from about 5 to about 40%, preferably from about 10 to about 30% of the dry weight of the said composition.

By analysing FIGS. 2 to 7, a person skilled in the art can define which conditions are best suited to carrying out the invention, as a function of the nature of the silicate chosen and of the desired form of detergent composition.

Figure 1:
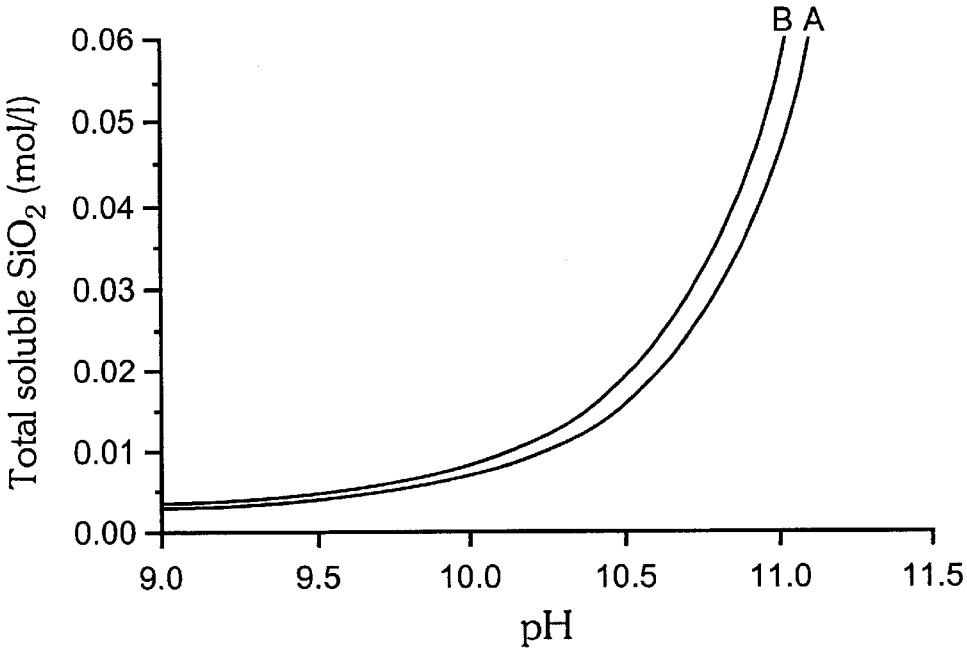
FIG. 1 represents the total concentration of soluble $SiO_2$ according to this equation as a function of the pH, for a chosen concentration of protonated silicic monomer $Si(OH)_4$.

For working concentrations other than those mentioned above and/or for silicates with other average $SiO_2/Na_2O$ molar ratios, a person skilled in the art can also determine the best conditions for carrying out the invention by a general study of FIG. 1 and/or with the aid of equation (I).

This analysis makes it possible to recommend for a detergent composition used at a concentration of 6 g/liter, with a pH of the washing medium of, for example, 10.5, the use in the said detergent composition

- of at least about 30%, preferably of at least about 36%, of sodium metasilicate
- of at least about 22%, preferably of at least about 27%, of sodium disilicate
- of at least about 20%, preferably of at least about 24%, of silicate with an average $SiO_2/Na_2O$ molar ratio of 3.3, for a detergent composition used at a concentration of 4 g/liter, with a pH of the washing medium of, for example, 10.5, the use in the said detergent composition

- of at least about 45%, preferably of at least about 55%, of sodium metasilicate
- of at least about 33%, preferably of at least about 40%, of sodium disilicate
- of at least about 30k, preferably of at least about 35%, of silicate with an average $SiO_2/Na_2O$ molar ratio of 3.3.

Once the nature and the amount of alkali metal silicate have been fixed, the pH of the washing medium is then adjusted by the choice and the amounts of the other ingredients which have an influence on the pH of the detergent composition.

The usual additives present in dishwasher detergent compositions and which have an influence on the pH of the washing medium are mainly basifying additives which are soluble in the washing medium, such as

- alkali metal phosphates (orthophosphates, pyrophosphates and polyphosphates such as tripolyphosphates in particular)
- alkali metal carbonates and percarbonates
- alkali metal borates and perborates
- alkali metal hydroxides, etc.

acidifying additives which are soluble in the washing medium, such as

- carboxylic or polycarboxylic acids which generate in the washing medium sequestering or dispersing compounds (citric acid, glutamic acid, glutaric acid, gluconic acid, tartaric acid, polyacrylic acids or copolymers thereof, fatty acids, etc.)
- alkali metal bicarbonates and sesquicarbonates
- phosphoric and polyphosphoric acids
- sulphonic acids
- phosphoric esters of acidic nature
- phosphonates of acidic nature
- boric acid
- alkali metal bisulphates, etc.

The dishwasher detergent compositions comprise at least one surfactant in an amount which can range from 0.5 to 10%, preferably from about 1 to about 5%, of the weight of the said detergent composition expressed as solids.

Among these surfactants, mention may be made of:

- anionic surfactants such as alkali metal soaps (alkali metal salts of $C_8$–$C_{24}$ fatty acids), alkaline sulphonates ($C_8$–$C_{13}$ alkylbenzene sulphonates, $C_{12}$–$C_{16}$ alkyl sulphonates), oxyethylenated and sulphated $C_6$–$C_{16}$ fatty alcohols, oxyethylenated and sulphated $C_8$–$C_{13}$ alkylphenols, alkaline sulphosuccinates ($C_{12}$–$C_{16}$ alkyl sulphosuccinates), etc.
- nonionic surfactants such as polyoxyethylenated $C_6$–$C_{12}$ alkylphenols, polyoxyethylenated and/or polyoxypropylenated $C_8$–$C_{22}$ aliphatic alcohols, ethylene oxide/propylene oxide block copolymers, optionally polyoxyethylenated carboxylic amides, etc.

These surfactants have little influence on the pH of the washing medium.

Among the other usual additives forming part of the formulation of detergent compositions for washing in a dishwasher, mention may be made in particular of

- "builders" (agents for improving the surface properties of surfactants) such as:
  - soluble inorganic alkali metal phosphates, in particular alkali metal tripolyphosphates in a proportion of from 0 to 70% of the total weight of the detergent composition expressed as solids;
  - organic phosphonates such as those of the range Dequest® from Monsanto, in a proportion of from 0 to 2% of the total weight of the detergent composition expressed as solids;
  - nitriloacetic acid, N,N-dicarboxymethyl-2-aminopentanedioic acid, ethylenediaminetetraacetic acid or diethylenetriaminepentaacetic acid, in a proportion of from 0 to 10% of the total weight of the detergent composition expressed as solids;
  - citric acid, gluconic acid or tartaric acid, or salts thereof, in a proportion of from 0 to 10% of the total weight of the detergent composition expressed as solids;
- bleaching agents such as perborates or percarbonates, which may or may not be combined with acetylated bleaching activators such as N,N,N',N'-tetraacetyl-ethylenediamine (TAED) or chlorinated products such as chloroisocyanurates, for the solid compositions, or chlorinated products such as alkali metal hypochlorites, for the liquid compositions, in a proportion of from 0 to 30% of the total weight of the said detergent composition expressed as solids;
- auxiliary cleaning agents such as copolymers of acrylic acid and of maleic anhydride or acrylic acid homopolymers, in a proportion of from 0 to 10% of the total weight of the said detergent composition expressed as solids;
- alkaline agents such as alkali metal borates, carbonates, bicarbonates or sesquicarbonates, in a proportion of from 0 to 50% of the total weight of the said composition expressed as solids;
- fillers such as sodium sulphate or sodium chloride for the detergents in powder form, in a proportion of from 0 to 50% of the total weight of the said composition expressed as solids; these fillers have little influence on the pH;
- various other additives, such as enzymes in the case of solid compositions, in an amount which can range up to 10% of the total weight of the said composition expressed as solids, fragrances, dyes, metal-corrosion inhibitors, etc.

As has already been mentioned above, any type of soluble alkali metal silicate can be used in the detergent composition of the invention.

Thus, anhydrous and/or hydrated metasilicates ($SiO_2/M_2O$ molar ratio of 1) in the form of powder or granules can be present according to the invention in a detergent composition in powder or tablet form. The pH of the washing bath may be adjusted to a value of greater than 9.8, preferably from about 9.9 to about 11.1, by the presence in the said composition of an acidifying agent or additive such as citric acid, sodium bicarbonate, sodium sesquicarbonate or any other acidifying agent.

The amorphous "disilicates" (average $SiO_2/M_2O$ molar ratio of greater than 1 and less than 2.5) can be present, in compacted sprayed form in a detergent composition in powder or tablet form, in the form of a concentrated solution generally containing about 45% solids in a liquid detergent composition or in a composition in gel form; they can also be present in the form of a solid preformulation in a preformulation composition in powder or tablet form, preferably in the form of cogranules, obtained by adsorption and/or absorption of a concentrated alkali metal silicate solution generally containing about 45% solids onto a soluble inorganic support such as alkali metal tripolyphosphate and/or alkali metal carbonate and/or alkali metal bicarbonate and/or alkali metal sesquicarbonate and/or alkaline sulphate, the amount of water remaining bound to the silicate corresponding to a ratio: silicate-bound water/silicate expressed as solids of at least 20/100, preferably of at least 30/100.

The expression "silicate-bound water" is intended to refer to the water in the supported solution which is not combined with the inorganic support, in particular in the form of crystalline hydrate. This can be measured in particular by X-ray diffraction, solid proton or phosphorus NMR, etc.).

The pH of the washing bath may be adjusted to a value of greater than 9.8, preferably from about 9.9 to about 11.1, by the presence in the said composition of an acidifying agent or additive such as citric acid, sodium bicarbonate, sodium sesquicarbonate or any other acidifying agent.

Preferably, the alkali metal silicate, in particular sodium silicate, used in the detergent compositions of the invention is amorphous and has an average $SiO_2/M_2O$ molar ratio from about 2.5 to about 4.2.

Its mode of use in a detergent composition depends on the form of detergent composition for which it is intended, i.e. a solid detergent composition (powder or tablets), a liquid detergent composition or a composition in gel form.

The said alkali metal silicate with an average $SiO_2/M_2O$ molar ratio from about 2.5 to about 4.2 can be used most particularly in the form of a concentrated aqueous solution generally containing from about 25 to about 50% solids or in the form of a liquid preformulation in a liquid or gel detergent composition, or in the form of a solid preformulation in a composition in powder or tablet form.

Thus, when it is intended for a solid detergent composition, it can preferably be used in the form of a solid preformulation, in particular in the form of cogranules, obtained by adsorption and/or absorption of a concentrated alkali metal silicate solution onto at least one water-insoluble or preferably water-soluble inorganic support, the amount of water remaining bound to the silicate corresponding to a ratio: silicate-bound water/silicate expressed as solids of at least 20/100, preferably of at least 30/100.

Among the water-insoluble inorganic supports, mention may be made of natural or synthetic, amorphous or crystalline sodium silicoaluminates, calcium carbonate, clays, magnesium silicates, calcium silicates, silica, etc.

Among the water-soluble inorganic supports, mention may be made of alkali metal tripolyphosphates, alkali metal carbonates, alkali metal bicarbonates, alkali metal sesquicarbonates, alkaline sulphates, etc.

If necessary, the pH of the washing bath may be adjusted to a value of greater than 9.8, preferably from about 9.9 to about 10.8, by the presence in the said composition of a basifying agent or additive or of an acidifying agent or additive.

A first type of solid preformulation consists of cogranules obtained by adsorption and/or absorption of a concentrated alkali metal silicate solution with an average $SiO_2/M_2O$ molar ratio from about 2.5 to about 4.2, preferably from about 2.6 to about 3.5, adsorbed and/or absorbed onto at least one water-soluble inorganic support which is compatible with the desired pH, in particular such as sodium sesquicarbonate and/or mixtures of sodium carbonate and sodium bicarbonates and/or, preferably, sodium tripolyphosphate, the silicate/inorganic support weight ratio, expressed as solids, being from about 20/80 to about 60/40, preferably from about 25/75 to about 50/50, and optionally drying until the amount of water present in the said preformulation represents from about 10 to about 35% of the weight of the said preformulation, and until the amount of water remaining bound to the silicate corresponds to a ratio: silicate-bound water/silicate expressed as solids of at least 20/100, preferably of at least 30/100.

A first specific type of solid detergent composition forming the subject of the invention consists of a solid detergent composition as described above, in which the alkali metal silicate has an average $SiO_2/M_2O$ molar ratio from about 2.5 to about 4.2, preferably from about 2.6 to about 3.5, and is used via the said first type of solid preformulation, the pH of this preformulation at its concentration in the washing medium being greater than 9.8, preferably from about 9.9 to about 10.8, in accordance with equation (I) mentioned above.

A second type of solid preformulation consists of cogranules obtained by adsorption and/or absorption of a concentrated alkali metal silicate solution with an average $SiO_2/M_2O$ molar ratio from about 3 to about 4.2, preferably from about 3.3 to about 4, adsorbed and/or absorbed onto sodium carbonate, the silicate/carbonate weight ratio, expressed as solids, being from about 40/60 to about 80/20, preferably from about 50/50 to about 70/30, and optionally drying until the amount of water present in the said preformulation represents from about 15 to about 35% of the weight of the said preformulation, and until the amount of water remaining bound to the silicate corresponds to a ratio: silicate-bound water/silicate expressed as solids of at least 20/100, preferably of at least 30/100.

A second specific type of solid detergent composition forming the subject of the invention consists of a solid detergent composition as described above, in which the alkali metal silicate has an average $SiO_2/M_2O$ molar ratio from about 3 to about 4.2, preferably from about 3.3 to about 4, and is used via the said second type of solid preformulation, the pH of this preformulation at its concentration in the washing medium being greater than 9.8, preferably from about 9.9 to about 10.8, in accordance with equation (I) mentioned above.

When the said silicate is intended for a liquid detergent composition or a composition in gel form, this silicate has an average $SiO_2/M_2O$ molar ratio from about 2.5 to about 3.5, preferably from about 2.6 to about 3.3; it is used in the form of a commercial concentrated aqueous solution containing from about 25 to about 50% solids, or in the form of a liquid preformulation in the form of a dispersion in the said concentrated solution of silicate of a water-soluble inorganic compound.

One type of liquid preformulation consists of a dispersion, in a concentrated silicate solution with an average $SiO_2/M_2O$ molar ratio from about 2.5 to about 3.5, preferably from about 2.6 to about 3.3, containing from about 25 to about 50% solids, of a water-soluble inorganic sodium tripolyphosphate, which is preferably sprayed, and/or sodium carbonate compound, the silicate/water-soluble inorganic compound weight ratio, expressed as solids, being from about 70/30 to about 30/70, preferably from about 60/40 to about 35/65, the amount of water present in the said preformulation representing from about 40 to about 65% of the weight of the said preformulation.

One specific type of liquid detergent composition forming the subject of the invention consists of a liquid detergent composition as described above, in which the alkali metal silicate has an average $SiO_2/M_2O$ molar ratio from about 2.5 to about 3.5, preferably from about 2.6 to about 3.3, and is used via the said type of liquid preformulation, the pH of this preformulation at its concentration in the washing medium being greater than 9.8, preferably from about 9.9 to about 10.9, in accordance with equation (I) mentioned above.

The examples which follow are given for illustrative purposes.

EXAMPLES 1–2

Test of Corrision of Glass and of Glass Patterns in a Dishwasher

Two dishwasher formulations, whose composition is given in Table 1, are prepared by introducing, respectively, a mixture (A) consisting of sprayed sodium silicate with a ratio $R=SiO_2/Na_2O$ of 2.1 and of Rhodiaphos LV sodium tripolyphosphate, and cogranules (B) consisting of sodium silicate with a ratio $R=SiO_2/Na_2O$ of 3.11 supported on sodium tripolyphosphate (TPP), the composition of which cogranules is as follows:

| Cogranules (B) | |
|---|---|
| Constituents | % by weight |
| TPP (dry) | 52 |
| Silicate R = 3.11 (dry) | 28 |
| Water | 20 |
| pH of the cogranules (B) at their concentration in the washing medium | 10.3 |

The $Si(OH)_4$ concentration is calculated in accordance with equation (I), from the pH measurement of the washing medium and from the total amount of $SiO_2$.

Evaluation of the Visible Corrosion 50 washing-rinsing-drying cycles are carried out in a Bosch® SMS 7086 domestic machine.

Two different types of unpatterned glass and two types of patterned glass (see Table 1) are placed in the top tray.

The temperature cycle chosen is 65° C.; the dose of detergent composition used for each wash is 30 g for a 5 liter volume of washing water; after each washing-rinsing-drying cycle, the door is left closed for 10 minutes and then left open for 10 minutes.

The evaluation of corrosion is made visually with a scale ranging from 1 to 5 points, taking the glasses in the new state as reference, by 9 trained individuals.

The points are distributed as follows:

1 point corresponds to a perfect state 2 points correspond to damage which is just barely visible (white or coloured traces on the unpatterned glass; dulling of the pattern on the glass)

3 points correspond to very clear damage which is immediately visible (unpatterned glass coloured or whitened overall, with possible presence of local defects; the patterns on the glass are dull, with fading of the colours)

4 points correspond to considerable damage (the unpatterned glass also has large white marks; the patterns on the glass have partially disappeared)

5 points correspond to totally deteriorated surfaces (the surface is entirely damaged; the patterns have disappeared).

Evaluation of the loss of mass:

Measuring the relative loss of mass (LM) of the samples makes it possible to quantify the thickness of the damaged (dissolved) surface; it is expressed in thousandths of a %. This corresponds to LM=[(mass after test−initial mass)/initial mass]×100,000. The results are given in Table 1. They show that the use of sodium silicate cogranules (B) with a ratio of 3.11 supported on sodium tripolyphosphate, under conditions corresponding to an $Si(OH)_4$ concentration of 3.75 mmol/liter of washing medium results in total inhibition of corrosion of the glass and of the patterns on the glass, observed by the absence of visible corrosion and virtually no loss of mass. In contrast, substantial and heterogeneous iridescence of the surface of unpatterned glass and damage to the patterns on glass is observed, with the same amount (as dry material) of mixture (A) of sodium silicate with a ratio of 2.1 and of sodium tripolyphosphate corresponding to $Si(OH)_4$ concentration conditions of 1.1 mmol/liter of washing medium; this visible corrosion is confirmed by a considerable loss of mass of the glass.

EXAMPLES 3–8

Solid Detergent Formulations Containing TPP—Test of Corrosion of Glass in a Dishwasher Six solid dishwasher formulations, whose composition is given in Table 2, are prepared by introducing one of the mixtures (C) and (D) or of the cogranules (E) and (F) below:

mixture (C) consisting of Rhodiaphos LV sodium tripolyphosphate and of cogranules of anhydrous sodium metasilicate (ratio $R=SiO_2/Na_2O$ of 1) and of hydrated sodium metasilicate (ratio $R=SiO_2/Na_2O$ of 1) sold by Rhône-Poulenc under the name GA5;

mixture (D) consisting of Rhodiaphos LV sodium tripolyphosphate and of sprayed sodium silicate with a ratio $R=SiO_2/Na_2O$ of 2.1;

cogranules (E) consisting of sodium silicate with a ratio $R=SiO_2/Na_2O$ of 3.11 supported on sodium tripolyphosphate (TPP) containing 26% of their weight of water;

cogranules (F) consisting of sodium silicate with a ratio $R=SiO_2/Na_2O$ of 3.11 supported on sodium tripolyphosphate (TPP) containing 20% of their weight of water.

Corrosion tests are carried out as described above, on standard plain glasses (round wine glass and round fruit bowl).

The results obtained (average values of the loss of mass gradings) are featured in Table 2.

These results show that the visible corrosion is greatly reduced in the case of the formulation of Example 7 ($Si(OH)_4$ concentration of 2.61 mmol/l) and nonexistent in the case of that of Example 8 ($Si(OH)_4$ concentration of 3.25 mmol/l).

Similarly, it is observed that the loss of mass becomes negligible once the $Si(OH)_4$ concentration reaches 2.61 mmol/l.

EXAMPLES 9–11

Liquid Detergent Formualtions Containing TPP—Test of Corrosion of Glass in a Dishwasher Three liquid formulations L1, L2 and L3 are prepared by placing sprayed TPP in suspension in a concentrated silicate solution with different ratios $R=SiO_2/Na_2O$, and by adding thereto sodium hypochlorite as bleaching agent and a non-foaming surfactant which is compatible with sodium hypochlorite.

Their composition is featured in Table 3.

The composition of formulation L3 is similar to that of commercial formulations.

The three compositions are used in a proportion of 32 g per wash.

The corrosion tests are carried out as described above, on standard plain glasses (round wine glass and round fruit bowl) and on standard patterned glasses (with a cherry pattern and with a red border pattern), after 100 washing cycles.

The results obtained (average values of the loss of mass gradings) are featured in Table 3.

An absence of corrosion is observed for formulations L1 and L2 according to the invention.

EXAMPLES 12–14

Test of Glass Corrosion

This simplified glass corrosion test reproduces certain dishwasher washing conditions, in particular the washing, rinsing and drying cycles.

Nature of the Glass

The glass used consists of microscope slides 2.5×7.5 cm in size, precleaned with ethanol, the composition of which slides, given below, is similar to that of ordinary drinking glasses.

Si: 21–43% by weight

Ca: 2.8–5.8% by weight

Mg: 1.6–3.4% by weight

Na: 6.8–14.2% by weight

Al: 0.3–0.7% by weight

Procedure 200 ml of an aqueous washing solution containing 6 g/l of test product are placed in a container. The container is placed and kept in an oven at 65° C. for 1 hour. A glass slide is totally immersed in this container, in an inclined position. Next, the container is closed and then placed in an oven at 65° C. The slide is removed from the container after 16 hours, rinsed twice on each face with deionized water using a wash bottle, wiped with a finger to remove the film which may have formed, and dried in ambient air for 2 hours.

At the end of the test, the slide is weighed after cooling to ambient temperature and the relative variation in mass (as %×1000) is calculated. The test is repeated once more to confirm the results.

The corrosion which is visible to the eye is evaluated relative to a reference slide not subjected to the test.

Lastly, the pH of the solutions is measured at ambient temperature before immersion of the slide and at the end of the experiment.

This simplified test makes it possible to rapidly reproduce the various types of glass corrosion obtained by repeated washing in a dishwasher, the succession of washing-rinsing-drying cycles, and under concentration and temperature conditions similar to is those used in dishwashers.

Dishwasher formulations are prepared by introducing cogranules consisting of TPP and of sodium silicate with a ratio $SiO_2/Na_2O=3.3$, the general composition of these cogranules being as follows:

TPP content (by weight)=51.7% silicate content (by weight)=22.2% water content (by weight)=26.2% as alkaline agents in a dishwasher formulation composition given in Table IV.

The above glass corrosion test is carried out. The results are featured in Table IV.

EXAMPLES 15–18

Dishwasher formulations are prepared by introducing cogranules consisting of sodium silicate with a ratio $SiO_2/Na_2O=3.9$ and of light sodium carbonate, the general composition of these cogranules being as follows:

carbonate content (by weight)=25.5% silicate content (by weight)=31.1% water content (by weight)=37.4% as alkaline agents in a dishwasher formulation composition (free of sodium tripolyphosphate) given in Table V.

The above glass corrosion test (described in Examples 12–14) is carried out for 65 hours (instead of 16 hours).

The results are given in Table V.

TABLE I

| Example (mixture or cogranules) Formulation | (mixture A) comparative | (cogranules B) |
|---|---|---|
| Rhodiaphos LV (Na TPP containing 7% water) as is | 37 | |
| Na TPP * (expressed as solids) | | 34.4 |
| Sprayed silicate R 2.1 (containing 20% water) as is | 23.1 | |
| Silicate R 3.11 * (expressed as solids) | | 18.5 |
| Nonionic surfactants | 2 | 2 |
| Bleaching system (perborate, 1 $H_2O$ + TAED**) | 10 | 10 |
| Enzyme | 2 | 2 |
| Sodium sulphate | 25.9 | 20 |
| Water (qs 100) | 0 | 13.1 |
| pH | 10.8 | 10.24 |
| $Si(OH)_4$ (mmol/l) | 1.1 | 3.75 |

TABLE I-continued

| Corrosion | Visible appearance/ (grading) | Relative loss of mass (1000%) | Visible appearance/ (grading) | Relative loss of mass (1000%) |
|---|---|---|---|---|
| Standard round wine glasses | strong iridescence (2.5) | 9.6 | as-new appearance (1) | −1.1 |
| Standard round fruit bowls | strong iridescence (2.5) | 9.9 | as-new appearance (1) | 3.4 |
| Glasses with a cherry pattern | Matt pattern (2.5) | 49.3 | as-new appearance (1) | 0.6 |
| Glasses with a red border pattern | Matt pattern (2.5) | 18.8 | as-new appearance (1) | −0.8 |

* introduced in the form of cogranules
** TAED aqueous solution containing 92% by weight of tetraacetylenediamine

TABLE II

| Example (mixture or cogranules) Formulation | 3 (C) comp. | 4 (D) comp. | 5 (E) comp. | 6 (F) comp. | 7 (E) | 8 (E) |
|---|---|---|---|---|---|---|
| Rhodiaphos LV (Na TPP containing 7% water) as is | 30.0 | 34.4 | | | | |
| Na TPP * (expressed as solids) | | | 35.0 | 34.5 | 35.0 | 35.0 |
| Metasilicate GAS | 53.3 | | | | | |
| Sprayed silicate R 2.1 (containing 20% water) as is | | 30.0 | | | | |
| Silicate R 3.11 * (expressed as solids) | | | 14.2 | 11.3 | 14.2 | 14.2 |
| Sodium carbonate | 0 | 8.7 | 20.0 | 5 | 5 | 0 |
| Sodium sulphate | 0 | 4.7 | 1.5 | 22.9 | 16.5 | 21.3 |
| Nonionic surfactants | 2 | 2 | 2 | 2 | 2 | 2 |
| Bleaching system (perborate, 1 $H_2O$ + TAED**) | 10 | 10 | 10 | 10 | 10 | 10 |
| Enzyme | 2 | 2 | 2 | 2 | 2 | 2 |
| Water | qs 100 | qs 100 | qs 100 | qs 100 | qs 100 | qs 100 |
| pH | 12.42 | 10.85 | 10.52 | 10.26 | 10.29 | 10.16 |
| $Si(OH)_4$ (mmol/l) | 0.02 | 1.60 | 1.69 | 2.19 | 2.61 | 3.25 |
| Corrosion | | | | | | |
| Grading | 1.2 | 3.8 | 3.3 | 2.3 | 1.6 | 1.0 |
| Relative loss of mass (1000%) | 44.4 | 23.9 | 18.2 | 11.6 | 1.8 | 1.2 |

* introduced in the form of cogranules
** TAED aqueous solution containing 92% by weight of tetraacetylenediamine

TABLE III

| Example Formulation | 9 L1 | 10 L2 | 11 L3 comparative. |
|---|---|---|---|
| Na TPP (expressed as solids) | 23.0 | 23.5 | 23.0 |
| Silicate R = 3.13 (expressed as solids) | 23.0 | | |
| Silicate R = 2.73 (expressed as solids) | | 23.5 | |
| Silicate R = 2 (expressed as solids) | | | 23.4 |
| Surfactant | 0.6 | 0.5 | 1.6 |
| Bleaching agent | 1.5 | 1.5 | 2 |
| Water | 51.9 | 51.0 | 50.0 |
| pH | 10.28 | 10.42 | 11.14 |
| $Si(OH)_4$ (mmol/l) | 4.14 | 3.26 | 0.60 |
| Corrosion | | | |
| Plain glass - grading - | 1.00 | 1.00 | 4 |
| Plain glass - relative loss of mass (1000%) - | 0 | 0 | 18.59 |
| Patterned glass - grading - | 1.00 | 1.00 | 2.62 |
| Patterned glass - relative loss of mass (1000%) - | 0 | 0 | 39.42 |

TABLE IV

| Example Formulation | 12 | 13 comparative | 14 comparative |
|---|---|---|---|
| TPP/silicate cogranules | 67.7 | 67.7 | 67.7 |
| Sodium carbonate | 0 | 10 | 15 |
| Sodium sulphate | 21.3 | 11.3 | 6.3 |
| Nonionic surfactants | 1 | 1 | 1 |
| Bleaching system (perborate, 1 $H_2O$ + TAED**) | 10 | 10 | 10 |
| pH | 10.16 | 10.37 | 10.45 |
| $Si(OH)_4$ (mmole/l) | 3.48 | 2.41 | 2.08 |
| Corrosion | | | |
| Grading | 1 | 2.5 | 3 |
| Relative loss of mass (1000%) | 0.00 | 46.84 | 48.80 |

**TAED Aqueous solution containing 92% by weight of tetraacetylenediamine

TABLE V

| Example Formulation | 15 | 16 | 17 | 18 |
|---|---|---|---|---|
| Carbonate/silicate cogranules | 60 | 60 | 60 | 60 |
| Citrate | 17 | 0 | 17 | 0 |
| Sodium sulphate | 0 | 17 | 4.5 | 21.5 |
| Polyacrylate | 6 | 6 | 6 | 6 |
| Paraffin | 0.5 | 0.5 | 0.5 | 0.5 |
| Nonionic surfactant | 2 | 2 | 2 | 2 |
| Bleaching system (perborate, 1 $H_2O$ + TAED **) | 10 | 10 | 10 | 10 |
| Phosphonate | 4.5 | 4.5 | 0 | 0 |
| pH | 10.28 | 10.25 | 10.25 | 10.25 |
| $Si(OH)_4$ (mmole/l) | 3.85 | 4.06 | 4.06 | 4.27 |
| Corrosion | | | | |
| Grading | 1 | 1 | 1 | 1 |
| Relative loss of mass (1000%) | 0.00 | −1.06 | 0.00 | 1.05 |

** TAED Aqueous solution containing 92% by weight of tetraacetylenediamine

What is claimed is:

1. A method for washing glass, crystal or porcelain articles, and eliminating or limiting the corrosion of glass, crystal or porcelain articles and patterns on glass, crystal or porcelain by repeated washing in a dishwasher, said method comprising using a detergent composition comprising at least one soluble alkali metal silicate with an average $SiO_2/M_2O$ molar ratio from about 1 to about 4.2, wherein M represents an alkali metal, and generating a washing medium having a pH greater than 9.8 at a working concentration of 3 g/l to about 12 g/l and a concentration of protonated silicic monomer $Si(OH)_4$ of at least $2.5\times10^{-3}$ mol/liter of washing medium.

2. The method according to claim 1, wherein said concentration is at least $3\times10^{-3}$ mol/liter of washing medium.

3. The method according to claim 2, wherein said concentration is about $3\times10^{-3}$ to about $9\times10^{-3}$ mol/liter of washing medium.

4. The method according to claim 1, wherein the pH is from about 9.9 to about 11.1.

5. The method according to claim 1, wherein the soluble alkali metal silicate is amorphous and the average $SiO_2/M_2O$ molar ratio is from about 2.5 to about 4.2.

6. a dishwasher detergent composition comprising an effective amount of soluble alkali metal silicate(s) with an average $SiO_2/M_2O$ molar ratio from about 1 to about 4.2, wherein M represents an alkali metal, and said composition is non-corrosive towards glass, crystal, porcelain and any patterns present thereon, and said composition generates, at a working concentration, a washing medium with a concentration of protonated silicic monomer $Si(OH)_4$ of at least $2.5\times10^{-3}$ mol/liter of washing medium at a pH of greater than 9.8.

7. The dishwasher detergent composition according to claim 6, wherein said washing medium has a concentration of protonated silicic monomer $Si(OH)_4$ of at least $3\times10^{-3}$ mol/liter.

8. The dishwasher detergent composition according to claim 6, wherein the amount, by dry weight, of alkali metal silicate(s) represents from about 5 to about 55%, of the dry weight of said composition.

9. The dishwasher detergent composition according to claim 8, wherein the alkali metal silicate is a metasilicate in the form of powder or granules.

10. The dishwasher detergent composition, according to claim 8, wherein the alkali metal silicate is an amorphous disilicate in the form of a solid preformulation, which is obtained by adsorption and/or absorption of a concentrated alkali metal silicate solution containing about 45% solids onto a soluble inorganic support, the amount of water remaining bound to the silicate corresponding to a ratio: silicate-bound water/silicate expressed as solids of at least 20/100.

11. The dishwasher detergent composition according to claim 8, wherein the alkali metal silicate has an average $SiO_2/M^2O$ molar ratio from about 2.5 to about 4.2 and is used in the form of a concentrated aqueous solution containing from about 25 to about 50% solids, or in the form of a liquid preformulation in a liquid or gel detergent composition, or in the form of a solid preformulation in a composition in powder or tablet form.

12. The dishwasher detergent composition according to claim 11, wherein the alkali metal silicate has an average $SiO_2/M_2O$ molar ratio from about 2.5 to about 4.2, and is used via a solid preformulation consisting of cogranules obtained by adsorption and/or absorption of a concentrated alkali metal silicate solution with an average $SiO_2/M_2O$ molar ratio from about 2.5 to about 4.2, which is adsorbed and/or absorbed onto at least one water-soluble inorganic support which is compatible with the desired pH, chosen from sodium sesquicarbonate and/or mixtures of sodium carbonate and sodium bicarbonates and/or sodium tripolyphosphate, the silicate/inorganic support weight ratio, expressed as solids, being from about 20/80 to about 60/40, and optionally drying until the amount of water present in the said preformulation represents from about 10 to about 35% of the weight of the said preformulation, and until the amount of water remaining bound to the silicate corresponds to a ratio: silicate-bound water/silica expressed as solids of at least 20/100, the pH of this preformulation at its concentration in the washing medium being greater than 9.8.

13. The dishwasher detergent composition according to claim 11, wherein the alkali metal silicate has an average $SiO_2/M_2O$ molar ratio from about 3 to about 4.2, and is used via a solid preformulation consisting of cogranules obtained by adsorption and/or absorption of a concentrated alkali metal silicate solution with an average $SiO_2/M_2O$ molar ratio from about 3 to about 4.2, which is adsorbed and/or absorbed onto sodium carbonate, the silicate/carbonate weight ratio, expressed as solids, being from about 40/60 to about 80/20, and optionally drying until the amount of water present in the said preformulation represents from about 15 to about 35% of the weight of the said preformulation, and until the amount of water remaining bound to the silicate corresponds to a ratio: silicate-bound water/silicate expressed as solids of at least 20/100, the pH of this preformulation at its concentration in the washing medium being greater than 9.8.

14. The dishwasher detergent solution according to claim 11, wherein the alkali metal silicate has an average $SiO_2/M_2O$ molar ratio from about 2.5 to about 3.5, and is used via a liquid preformulation comprising a dispersion, in a concentrated silicate solution with an average $SiO_2/M_2O$ molar ratio from about 2.5 to about 3.5, containing from about 25 to about 50% solids, of a water-soluble inorganic sodium tripolyphosphate, and/or sodium carbonate compound, the silicate/water-soluble inorganic compound weight ratio, expressed as solids, being from about 70/30 to about 30/70, the amount of water present in the said preformulation representing from about 40 to about 65% of the weight of the said preformulation, the pH of this preformulation at its concentration in the washing medium being greater than 9.8.

* * * * *